United States Patent [19]

Itakura et al.

[11] Patent Number: 4,963,922

[45] Date of Patent: Oct. 16, 1990

[54] COPYING APPARATUS

[75] Inventors: Haruo Itakura; Kunio Ito, both of Hachioji, Japan

[73] Assignee: Konica Corporation, Tokyo, Japan

[21] Appl. No.: 394,584

[22] Filed: Aug. 16, 1989

[30] Foreign Application Priority Data

Aug. 20, 1988 [JP] Japan ..... 63-206613

[51] Int. Cl.[5] ..... G03G 21/00

[52] U.S. Cl. ..... 355/208; 355/77

[58] Field of Search ..... 355/204, 55, 207, 208, 355/314, 77

[56] References Cited

U.S. PATENT DOCUMENTS 4,090,787 5/1978 Hubbard et al. ..... 355/207 X 4,633,405 12/1986 Ito et al. ..... 355/314 X

FOREIGN PATENT DOCUMENTS 57-14854 1/1982 Japan .

*Primary Examiner*—Michael L. Gellner

*Assistant Examiner*—D. Rutledge

*Attorney, Agent, or Firm*—Frishauf, Holtz, Goodman & Woodward

[57] ABSTRACT

A copying apparatus includes a copy condition setting unit for setting copy conditions such as a copy count, a copy density, and a magnification. A standard mode setting unit initially sets the copy conditions upon starting of the apparatus to predetermined initial values, and a frequency calculating unit calculates a setting frequency of each copy condition set by the copy condition setting unit and the standard mode setting unit. When the frequency calculated by the frequency calculating unit exceeds a predetermined value, a correction unit corrects the corresponding copy condition to have the initial value set by the standard mode setting unit.

3 Claims, 5 Drawing Sheets

DATA FOR 1,000 COPIES
AFTER 5,000 COPIES
AFTER MAINTENANCE

DATA FOR 1,000 COPIES
AFTER MAINTENANCE

COPYING APPARATUS

BACKGROUND OF THE INVENTION

The present invention relates to a copying apparatus in which a standard mode is automatically initialized upon turning on of a power supply or the like.

In a conventional copying apparatus, setup conditions for a copying operation are prestored in a nonvolatile memory, and the prestored conditions are read out in response to a turn-on operation of a power switch or the like to perform initialization. For example, an initial setup condition for a copying image density is set assuming "a character image written on white paper".

However, some special users often use color originals or picture image originals as compared to line images. Thus, they cannot use the image density of the initial setup condition as it is, and must frequently shift (correct) the image density from the initial setup condition for every copying operation.

As a copy count is increased, a decrease in amount of light caused by contamination in the apparatus, or a copy fogging, a decrease in image density, or the like caused by a degradation of a drum performance tends to occur. In this case, in a conventional apparatus, an image density setup condition must be corrected on the basis of a trial copy result, or an internal image density shift function must be set, resulting in a cumbersome operation.

SUMMARY OF THE INVENTION

The present invention has been made in consideration of the above situation, and has as its object to provide a copying apparatus which can eliminate a need for a shift/correction operation of copy setup conditions as much as possible and can attain an efficient copying operation.

In order to achieve the above object of the present invention, copy setup conditions or data stored for every copying operation are totaled in units of a predetermined copy count, characteristic setup conditions inherent to the apparatus are extracted from the total, and a standard mode is corrected to coincide with the characteristic setup conditions, thus presetting optimal copying conditions.

DETAILED DESCRIPTION OF THE PREFERRED EMBODIMENT

Figure 1:
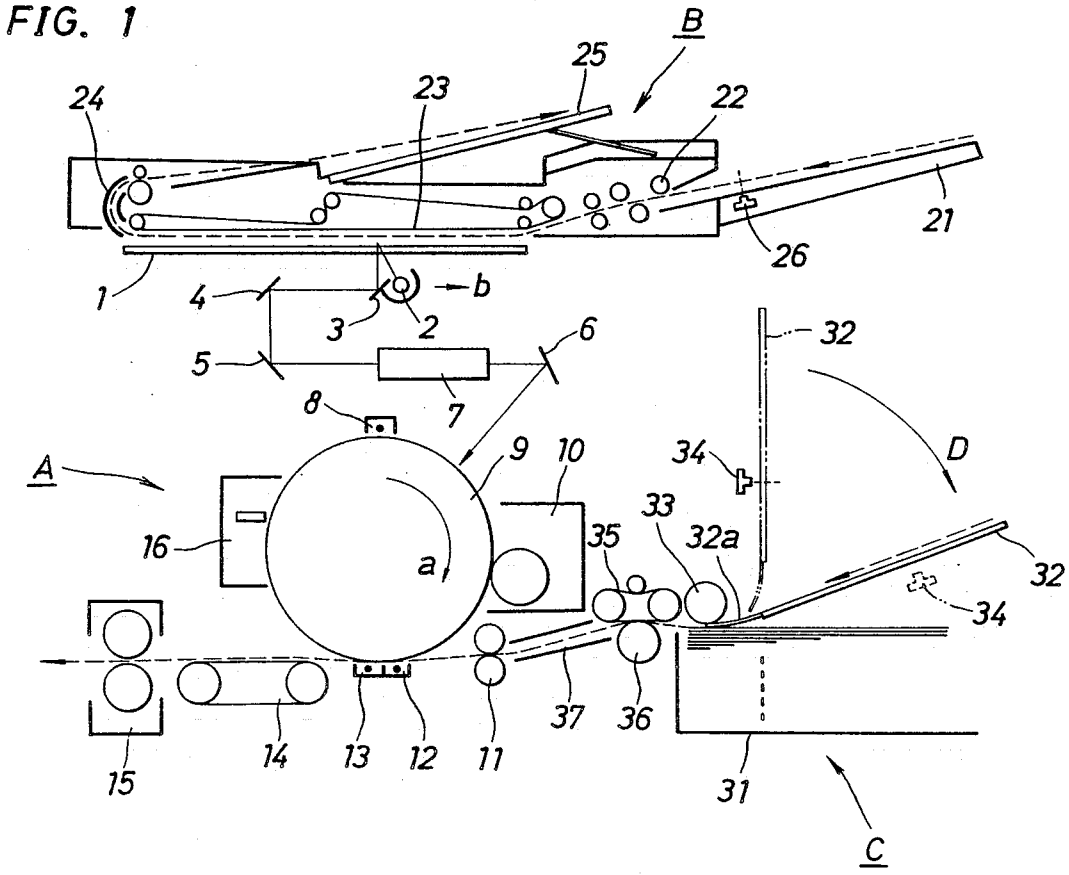
FIG. 1 is a schematic view showing an arrangement of a copying apparatus according to an embodiment of the present invention.

An embodiment of the present invention will be described hereinafter. FIG. 1 shows a schematic arrangement of a copying apparatus according to the embodiment of the present invention. The copying apparatus is constituted by a main body section A, an automatic document feeder (ADF) B, and a paper supply section C.

In the main body section A, an original is exposed by scanning by a relative movement of the original on the upper surface of a platen glass 1 and a light source 2, and an optical image of the original becomes incident on a photosensitive drum 9 precharged to a high voltage by a charging electrode 8 via mirrors 3 to 6 and a lens system 7, thus forming an electrostatic latent image. The latent image is developed by a developing unit 10 to be converted to a toner image. The toner image is transferred onto a transfer paper sheet fed from registration rollers 11 by a transfer electrode 12. The transfer sheet is peeled from the photosensitive drum 9 by a peeling electrode 13. The sheet is conveyed to thermal fixing rollers 15 by a conveyor belt 14. The toner image on the sheet is fixed by the fixing rollers, and the sheet is then exhausted. Residual toner on the photosensitive drum 9 is cleaned by a cleaning unit 16, and the drum is charged by the charging electrode 8 again to prepare for the next latent image formation.

The ADF B is entirely set on the upper surface of the platen glass 1. An original placed on an original tray 21 is guided to a supply belt 23 by a roller group 22. The original is conveyed onto the platen glass 1 and is stopped at a specific position or is caused to travel along the platen glass 1 at a constant speed to be subjected to exposure. The exposed original is fed to an original exhaust tray 25 from a guide 24. When originals are set on the original tray 21, they are detected by a sensor 26.

The paper supply section C comprises a cassette 31 as a main paper supply unit in which a plurality of paper sheets of the same type are stacked, and a manual supply tray 32 as a manual supply unit which is pivoted from the side indicated by a broken line in a direction of an arrow D. When the manual supply tray 32 is set to be pivoted in the direction of the arrow D, a distal end (lower end) **32*a* of the manual supply tray 32 is inserted below the lower surface of a pickup roller 33 which presses the uppermost sheet in the cassette 31. The upright state (state indicated by an imaginary line in FIG. 1) or the set state (state indicated by a solid line in FIG. 1) of the manual supply tray 32 is detected by a sensor 34. Reference numeral 35 denotes an anti-overlap supply belt; 36, a roller; and 37**, a guide.

Figure 2:
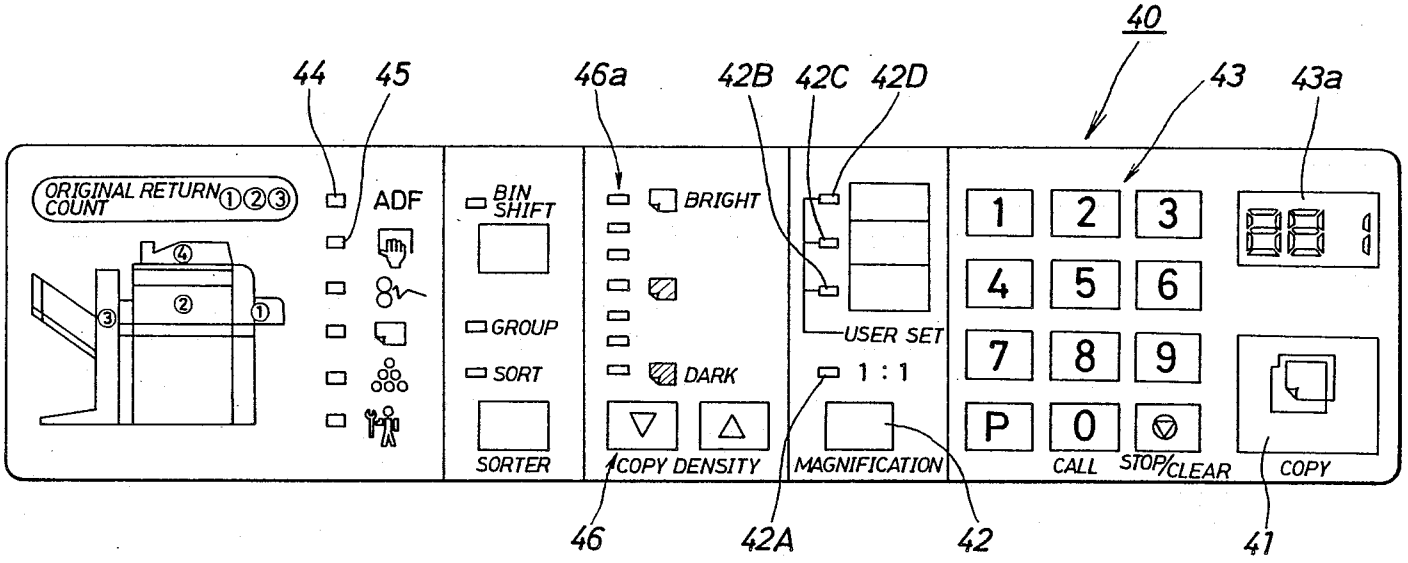
FIG. 2 is a plan view of an operation unit of the apparatus shown in FIG. 1.

FIG. 2 shows an operation unit 40 disposed on the upper surface of the main body section A, on which buttons for indicating various operations and setting data, and displays and indicators for displaying and indicating the corresponding states are arrayed. Reference numeral 41 denotes a copy button; 42, a magnification setup button; and 42A to 42D, selected magnification displays. The display 42A indicates a 1:1 magnification, and the displays 42B to 42D display magnifications preset by a user. Reference numeral 43 denotes a copy count setup button; **43*a*, a setup count display for displaying a copy count set upon operation of the copy count setup button 43; 44, an original indicator which is illuminated when the sensor 26 is turned on; 45, a manual supply indicator which is illuminated when the sensor 34 is turned on; 46, density setting buttons; and 46*a***, density indicators which are turned on in turn upon depression of the density setting button. The ON position of the density indicators reveals a setup density.

Figure 3:
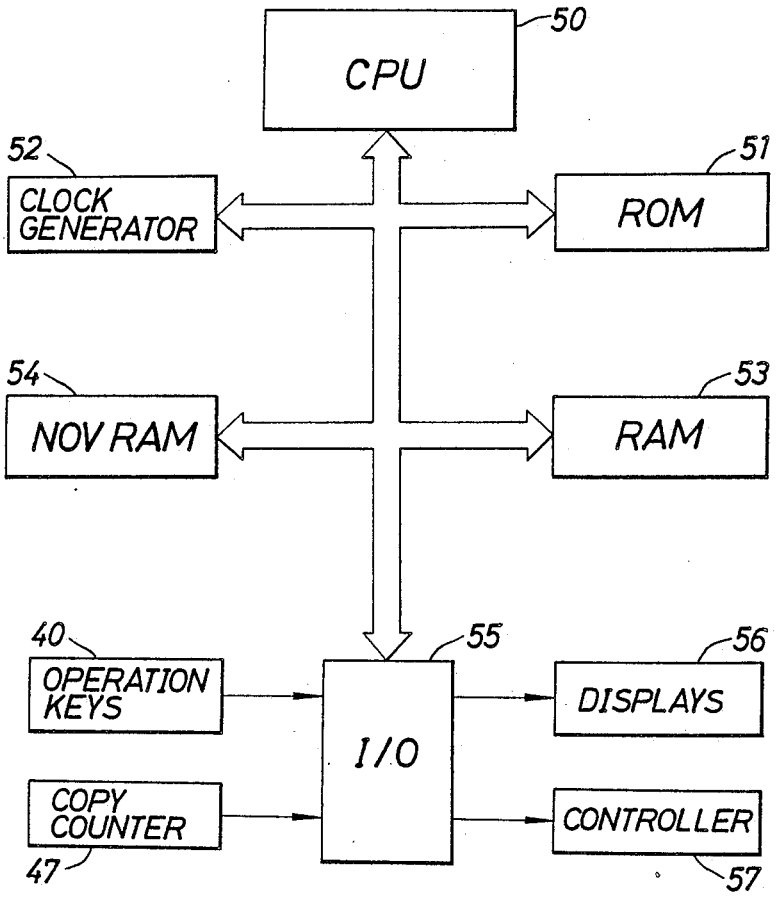
FIG. 3 is a block diagram of a control unit of the apparatus shown in FIG. 1.

FIG. 3 is a block diagram of a control unit of the copying apparatus. The control unit comprises a CPU (Central Processing Unit) 50 for controlling the entire apparatus, e.g., an image process, display control, and the like in accordance with operation inputs from operation keys (operation unit) 40, inputs from internal sensors (not shown), an input from a copy counter 47, and the like.

The CPU 50 is connected to a ROM 51 storing a control program, data, and the like, a clock generator 52 for generating a control timing signal, a work RAM 53 for temporarily storing data during control, a rewritable nonvolatile memory (NOVRAM) 54 for storing a total of copy modes (conditions), histograms unique to the copying apparatus, and the like, and an I/O port 55 serving as a data input/output unit.

The I/O port 55 is connected to the operation keys 40, the copy counter 47, displays 56, and a controller 57.

Items of copy conditions totaled by the NOVRAM 54 are a copy count, magnification, paper size, paper supply unit, selection of an automatic paper supply (APS) mode, selection of an automatic density (EE) mode, selection of an image density mode, selection of an automatic document feed (ADF) mode, selection of an automatic double-side (ADU) mode, selection of a sorter, and the like. These items are accumulated and stored for every copying operation.

Data obtained in this manner are totaled in units of items after, e.g., 1,000 copying operations to form histograms, and a ratio of key selections is calculated. For conspicuous selection features obtained from these data, initial setup conditions set as a standard mode are rewritten by conditions based on the above-mentioned data, and rewritten conditions are registered as a standard mode exclusively for a user of the copying apparatus. Therefore, the next copying operation in the standard mode (initial setup values) unique to the user can be performed without correcting setup conditions by the selection keys.

Of the conditions of the standard mode, data caused by a decrease in amount of light, degradation of a drum performance, or the like which can be recovered by a machine maintenance are ignored when the machine maintenance is performed, and the standard mode is reset to an initial value or a first correction value.

More specifically, when copy fogging tends to occur due to a decrease in amount of light caused by contamination in the apparatus, setup keys for increasing an image density are frequently selected. Even if a copying operation is performed in the EE mode, a density must be corrected to be increased so as to perform a copying operation. As a result, image setup key data indicates a total result shifted by one level in a bright direction. In this case, a standard density value is corrected to a brighter condition by one level to obtain a setup value. Thereafter, an optimal copy can be obtained without changing the initial setup conditions. However, when the machine maintenance is performed upon setting, the conditions are changed, and the apparatus is restored to an initial state. Therefore, correction based on the above data has no significance, and cannot be applied to the next copy conditions. In this case, the standard mode is reset to the initial value or an initial correction value, as described above.

Figure 4B:
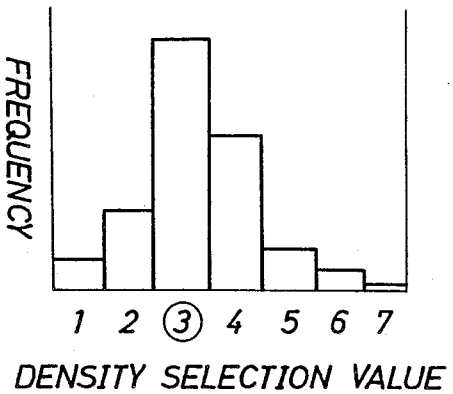
FIG. 4B is a histogram of 1,000 copies after 5,000 copies have been made after a maintenance procedure (that is, data for copies between 5000 and 6000 after a maintenance procedure)
Figure 4A:
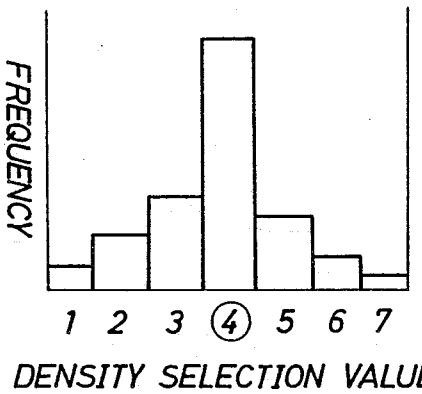
FIG. 4A is a histogram of 1,000 copies after a maintenance.

FIG. 4A shows a histogram of density selection data after 1,000 copies after the maintenance. In this histogram, a value "4" of the density selection values "1" to "7" indicates the highest frequency. In this case, "4" is stored in the NOVRAM 54 as a new standard density value. In the following copying operations, the density selection value "4" is set as a standard density value.

Thereafter, after every 1,000 copying operations, the density selection value indicating the highest frequency is obtained in the same manner as described above, and if the obtained density selection value is different from the standard density value, the standard density value is corrected by the difference. FIG. 4B shows a histogram of a density setup key for 1,000 copies after 5,000 copies have been made after a machine maintenance procedure (that is, data for copies between the 5000th and 6000th copies). The density selection value "3" indicates the highest frequency. In this case, the density selection value "3" is replaced with the previously set "4" as a new standard density value.

Figure 5:
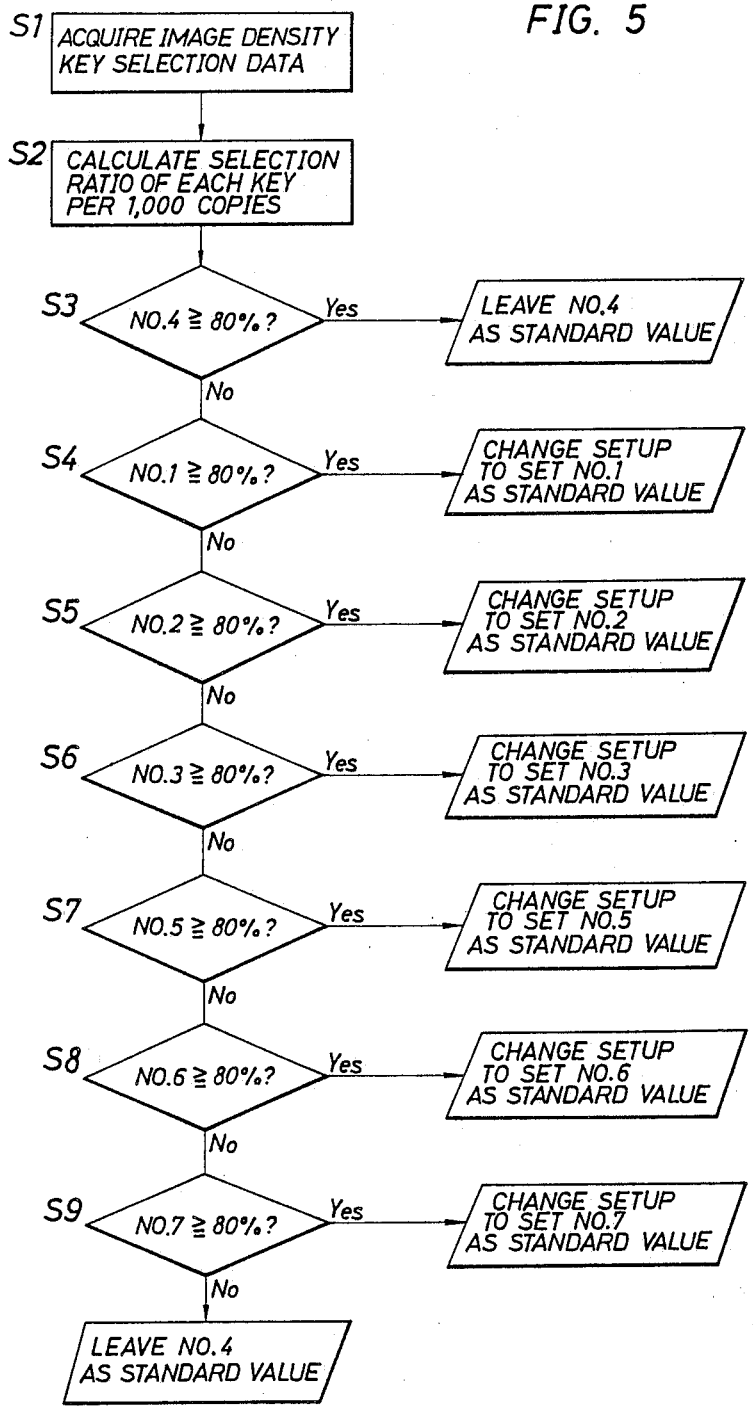
FIG. 5 is a flow chart of an image density standard value setup/change operation.

FIG. 5 is a flow chart showing a correction control program for standard mode conditions. In this flow chart, an initial standard density value is "4". In this flow chart, image density key selection data for 1,000 copying operations are acquired (step S1), and a selection ratio of each key per 1,000 copying operations is calculated (step S2). Note that "No." in FIG. 5 indicates the number of the density selection key (corresponding to the numbers in " " described above). As the number is smaller, it indicates a bright direction, i.e., that the interior of the apparatus is contaminated.

Of the density keys "1" to "7", if a key having a selection ratio of 80% or more is found, the density of the key is set as a new standard density value (steps S3 to S8). If no key exceeding 80% is found, the value "4" is left unchanged as a standard value (step S9).

According to the present invention, setup values of a standard mode are corrected to coincide with conditions most frequently used by a user to perform a copying operation. Therefore, the frequency of shift/correction operations for setting modes in the following copying operations can be reduced, and an efficient copying operation can be achieved.

As will be understood by those familiar with the art, the present invention may be embodied in other specific forms without departing from the spirit or essential characteristics thereof. Accordingly, the disclosure of the preferred embodiments of the present invention is intended to be illustrative, but not limiting, of the scope of the invention which is set forth in the following claims.

What is claimed is:

1. A copying apparatus comprising:

copy condition setting means for setting copy conditions such as a copy count, a copy density, and a magnification;

standard mode setting means for initially setting the copy conditions upon starting of said apparatus to predetermined initial values;

frequency calculating means for calculating a setting frequency of each copy condition set by said copy condition setting means and said standard mode setting means; and correction means for, when the frequency calculated by said frequency calculating means exceeds a predetermined value, correcting the initial value to the corresponding copy condition.

2. An apparatus according to claim 1, wherein said frequency calculating means comprises:

storing means for storing copy conditions for every copying operation;

totaling means for totaling the copy conditions stored in said storage means for each copy condition for every predetermined copy count; and calculating means for calculating a ratio of the value totaled by said totaling means to a total copy count and calculating the setting frequency of each copy condition on the basis of the ratio.

3. An apparatus according to claim 1, wherein when a predetermined machine maintenance is performed, correction by said correction means is canceled.

* * * * *